US009656321B2

(12) United States Patent
Cui et al.

(10) Patent No.: US 9,656,321 B2
(45) Date of Patent: May 23, 2017

(54) CASTING METHOD, CAST ARTICLE AND CASTING SYSTEM

(71) Applicant: GENERAL ELECTRIC COMPANY, Schenectady, NY (US)

(72) Inventors: Yan Cui, Greer, SC (US); Dechao Lin, Greer, SC (US); Ganjiang Feng, Greenville, SC (US); Srikanth Chandrudu Kottilingam, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 13/894,496

(22) Filed: May 15, 2013

(65) Prior Publication Data

US 2014/0342139 A1 Nov. 20, 2014

(51) Int. Cl.

| | |
|---|---|
| ***B22D 19/16*** | (2006.01) |
| ***B22D 21/02*** | (2006.01) |
| ***C22C 19/05*** | (2006.01) |

(52) U.S. Cl.

CPC ..... *B22D 19/16* (2013.01); *B22D 21/025* (2013.01); *C22C 19/056* (2013.01); *C22C 19/057* (2013.01); *Y10T 428/24992* (2015.01)

(58) Field of Classification Search

CPC ..... B22D 19/16; B22D 21/025; Y10T 428/24992

(Continued)

(56) References Cited

U.S. PATENT DOCUMENTS

| | | | | |
|---|---|---|---|---|
| 82,466 A | | 9/1868 | Wilmington | |
| 1,423,654 A | * | 7/1922 | Engel | 164/96 |

(Continued)

FOREIGN PATENT DOCUMENTS

| | | |
|---|---|---|
| CN | 1644274 A | 7/2005 |
| CN | 102189245 A | 9/2011 |

(Continued)

OTHER PUBLICATIONS

Piwonka, Thomas S., Solidifaction of Metals and Alloys, http://products.asminternational.org/asm/navon/CONTENT/MH/D26/A02/S0079484.html, Dec. 4, 2012.

(Continued)

*Primary Examiner* — Kevin P Kerns

(74) *Attorney, Agent, or Firm* — McNees Wallace & Nurick LLC

(57) ABSTRACT

A casting method, cast article and casting system are disclosed. The casting method includes providing a base material in a mold, directing a fluid material into the mold, and solidifying the base material and the fluid material to form a cast article. The base material has a first density and first composition. The fluid material has a second density and a second composition. The first density differs from the second density, the first composition differs from the second composition, or the first density differs from the second density and the first composition differs from the second composition. The cast article includes a first material solidification from the base material, and a second material solidification from the fluid material. The casting system includes a mold for containing a base material and an input configuration, with flow control feature, for directing a fluid material into the mold containing the base material.

20 Claims, 4 Drawing Sheets

(58) Field of Classification Search
USPC ..... 164/94, 95, 96
See application file for complete search history.

(56) References Cited

U.S. PATENT DOCUMENTS

| | | | | |
|---|---|---|---|---|
| 2,187,416 | A * | 1/1940 | Daniels | B22D 19/16 164/96 |
| 2,483,849 | A * | 10/1949 | Seaman | 164/96 |
| 2,841,846 | A * | 7/1958 | Kokichi | 75/244 |
| 3,847,203 | A | 11/1974 | Northwood | |
| 4,377,196 | A * | 3/1983 | Khandros | 164/66.1 |
| 5,000,244 | A * | 3/1991 | Osborne | 164/34 |
| 5,713,408 | A * | 2/1998 | Morando | 164/96 |
| 2005/0022959 | A1* | 2/2005 | Soderstrom et al. | B22D 27/045 164/122.1 |
| 2005/0211408 | A1* | 9/2005 | Bullied et al. | B22D 27/045 164/122.2 |
| 2007/0259200 | A1 | 11/2007 | Lequeu et al. | |
| 2014/0037981 | A1* | 2/2014 | Cui et al. | 428/615 |
| 2014/0363305 | A1* | 12/2014 | Shah et al. | B22D 19/16 416/241 R |

FOREIGN PATENT DOCUMENTS

| | | | |
|---|---|---|---|
| JP | 59193751 | A | 11/1984 |
| KR | 20030089910 | A | 11/2003 |

OTHER PUBLICATIONS

GB Search Report and Written Opinion issued in connection with corresponding GB Application No. GB1408245.7 dated Oct. 30, 2014.

* cited by examiner

CASTING METHOD, CAST ARTICLE AND CASTING SYSTEM

FIELD OF THE INVENTION

The present invention is directed to manufacturing methods and manufactured articles. More particularly, the present invention is directed to casting methods, cast articles, and casting systems.

BACKGROUND OF THE INVENTION

Various articles are assembled from more than one material, forming multiple portions of the article. In general, such articles are formed by securing a first material to a second material using a securing technique such as welding, adhering, fusing, soldering, brazing or a combination thereof. Such techniques suffer from various drawbacks. For example, such techniques can suffer from limited applicability to alloys, can be subject to fatigue, can delaminate, or combinations thereof.

Articles formed from combined alloys are often used in power generation systems, engines, bridges, buildings, wind turbines, and other large structures. Such structures are continuously subjected to increasing forces to provide improved efficiency and/or due to new environmental conditions. Such articles require increased resistance to fatigue, increased mechanical properties, increased capability of being fabricating, increased design life and reduced life cycle cost. Known components having two or more materials do not sufficiently meet all of the desired parameters.

As an alloy ingot cools, there are many factors which affect the final structure of the article formed. For example, when a molten alloy is poured into a mold, a temperature difference between the mold and the alloy causes thermal convection currents at the mold wall. The convection current contributes to segregation and the breaking off of metal dendrites forming on the wall. Those dendrites act as nuclei for the formation of equiaxed grains. Changing local compositions contributes to segregation, which further complicates grain formation. Additionally, the composition of the alloy and the rate at which the cast cools affect the final grain structure. Known casting methods do not sufficiently address such concerns regarding grain formation.

A casting method, a cast article, and a casting system that do not suffer from one or more of the above drawbacks would be desirable in the art.

BRIEF DESCRIPTION OF THE INVENTION

In an exemplary embodiment, a casting method includes providing a base material in a mold, directing a fluid material into the mold, and solidifying the base material and the fluid material to form a cast article. The base material has a first density and a first composition. The fluid material has a second density and a second composition. The first density differs from the second density, the first composition differs from the second composition, or the first density differs from the second density and the first composition differs from the second composition.

In another exemplary embodiment, a cast article includes a first material solidification from a base material, and a second material solidification from a fluid material. The base material has a first density and a first composition. The fluid material has a second density and a second composition. The first density differs from the second density, the first composition differs from the second composition, or the first density differs from the second density and the first composition differs from the second composition.

In another exemplary embodiment, a casting system includes a mold for containing a base material and an input configuration for directing a fluid material into the mold containing the base material. The input configuration includes a flow control feature for reducing or preventing an increase in a rate of the directing of the fluid material into the mold.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary casting method, cast article and casting system. Embodiments of the present disclosure, in comparison to methods and products not utilizing one or more features disclosed herein, increase fatigue resistance, increase oxidation resistance, reduce creep and reduce corrosion, improve weldability, or a combination thereof.

Figure 1:
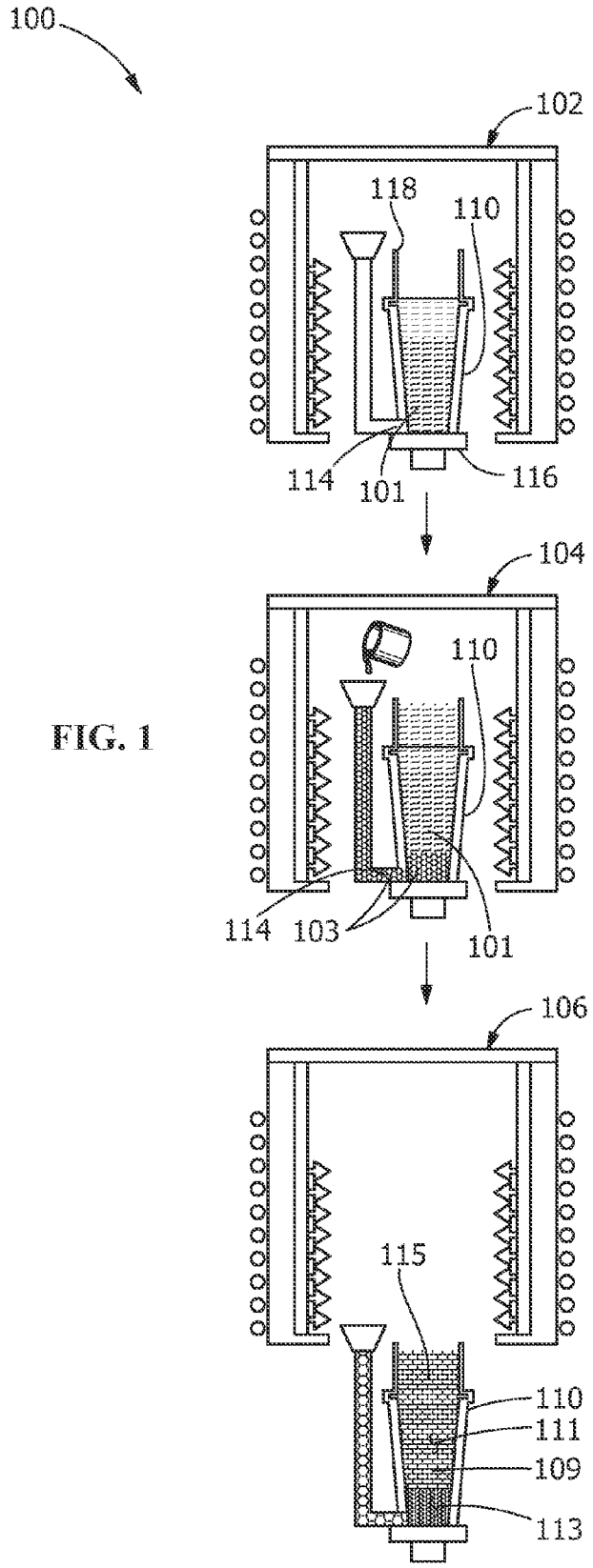
FIG. 1 is a schematic view of an exemplary casting method producing an exemplary cast article having equiaxed grain according to an embodiment of the disclosure.

Referring to FIG. 1, a casting method 100 includes providing a base material 101 having a first density and a first composition (step 102). In one embodiment, the base material 101 is directed into a mold 110. A fluid material 103 having a second density and second composition is directed into the mold 110 (step 104). The method 100 includes solidifying (step 106) the base material 101 and the fluid material 103 to form a cast article 109.

The base material 101 is any suitable material capable of being solidified, for example, after being melted or from a melted state. The fluid material 103 is any suitable material capable of flowing. The fluid material 103 is at a predetermined temperature, the predetermined temperature being above the solidus range and/or liquidus range for the fluid material 103. Suitable materials include, but are not limited to, metals, metallic alloys, superalloys, or combinations thereof.

In one embodiment, the base material 101 and the fluid material 103, when forged into alloys, include gamma prime microstructures.

In one embodiment, the first density of the base material 101 is different from the second density of the fluid material 103. The difference in density causes the base material 101 to separate from the fluid material 103 within the mold 110.

The resulting cast article 109 is formed having a first portion 111 and a second portion 113. The first portion 111 results from the base material 101 and the second portion 113 results from the fluid material 103. In one embodiment, the first portion 111 and the second portion 113 are separate and/or not intermixing in the cast article 109. In another embodiment, the first portion 111 and the second portion 113 are separated by a region of intermixing where both the first portion 111 and the second portion 113 are present. In one embodiment, the first portion 111 and the second portion 113 form a homogonous mixture throughout the cast article 109. In a further embodiment the cast article includes a first region and a second region. The first region has a first coefficient of thermal expansion, and the second region has a second coefficient of thermal expansion. In one embodiment, the first coefficient of thermal expansion differs from the second coefficient of thermal expansion.

Figure 2:
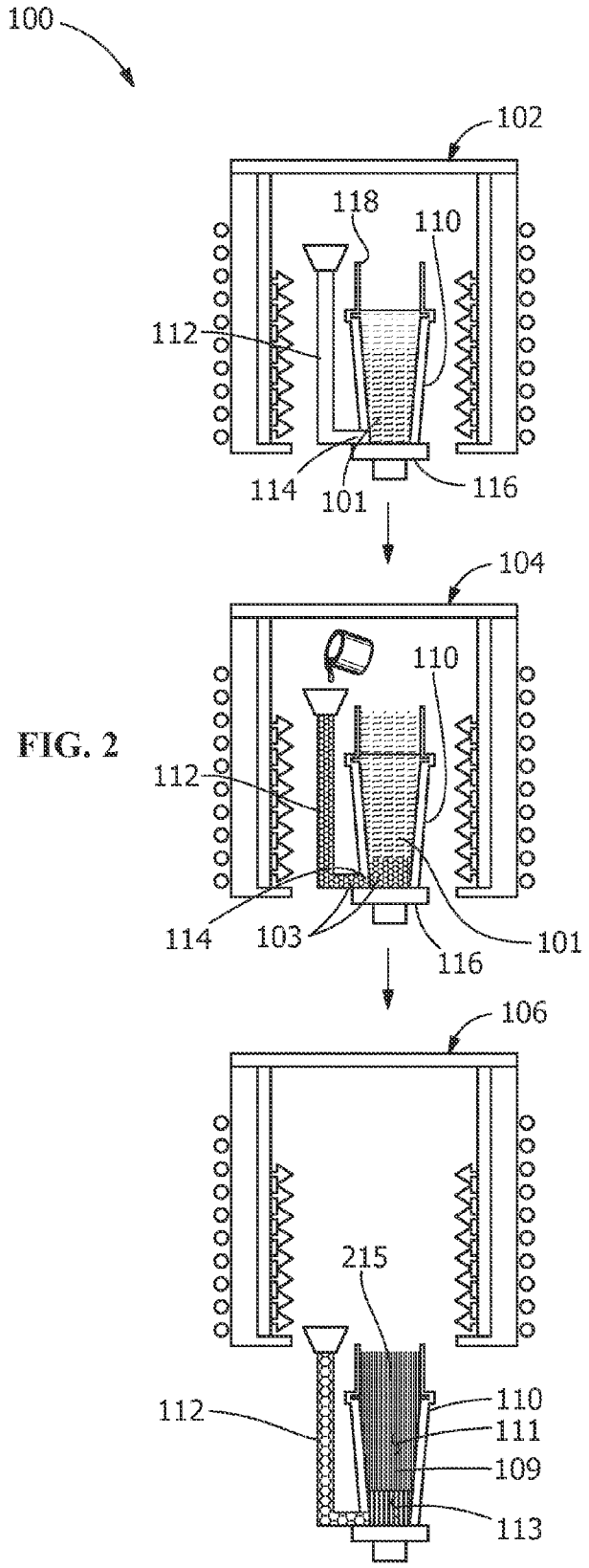
FIG. 2 is a schematic view of an exemplary casting method producing an exemplary cast article having directional solidification grain according to an embodiment of the disclosure.

The rate of the solidifying (step 106) controls the grain structure of the cast article 109 formed by the method 100. For example, in one embodiment, the rate resulting from a fast cooling method forms the cast article 109 having increased equiaxed grains 115 as compared to directional solidification grains 215, as shown in FIG. 1. In another embodiment, the rate resulting from a withdrawal cooling method forms the cast article 109 having increased directional solidification grains 215 as compared to equiaxed grains 115, as shown in FIG. 2.

Referring again to FIG. 1, in one embodiment, the mold 110 has a bottom-fed configuration. As used herein, directional language such as bottom-fed and bottom portion corresponds generally with the direction of gravity. The bottom-fed configuration has a fluid conduit extending outwardly from an opening in a lower portion 116 of the mold 110, in contrast to an upper portion 118 of the mold. In one embodiment, the fluid conduit has a first section connected to a second section, the first section being substantially vertical and the second section being substantially horizontal. A funnel is attached to the first section of the fluid conduit for directing materials into a receiving end of the first section. The second section directs material from the first section into the opening in the lower portion 116 of the mold 110. In one embodiment, the shape of the opening in the lower portion 116 of the mold 110 is one of, but is not limited to, a circle, a square, an oval, a slot, or a rectangle. In one embodiment, the fluid material 103 displaces the base material 101 from the lower portion 116 of the mold 110, forcing the base material 101 upwards. As used herein, directional language, such as upwards, top-fed and upper portion, corresponds generally with the opposite direction of gravity.

Figure 3:
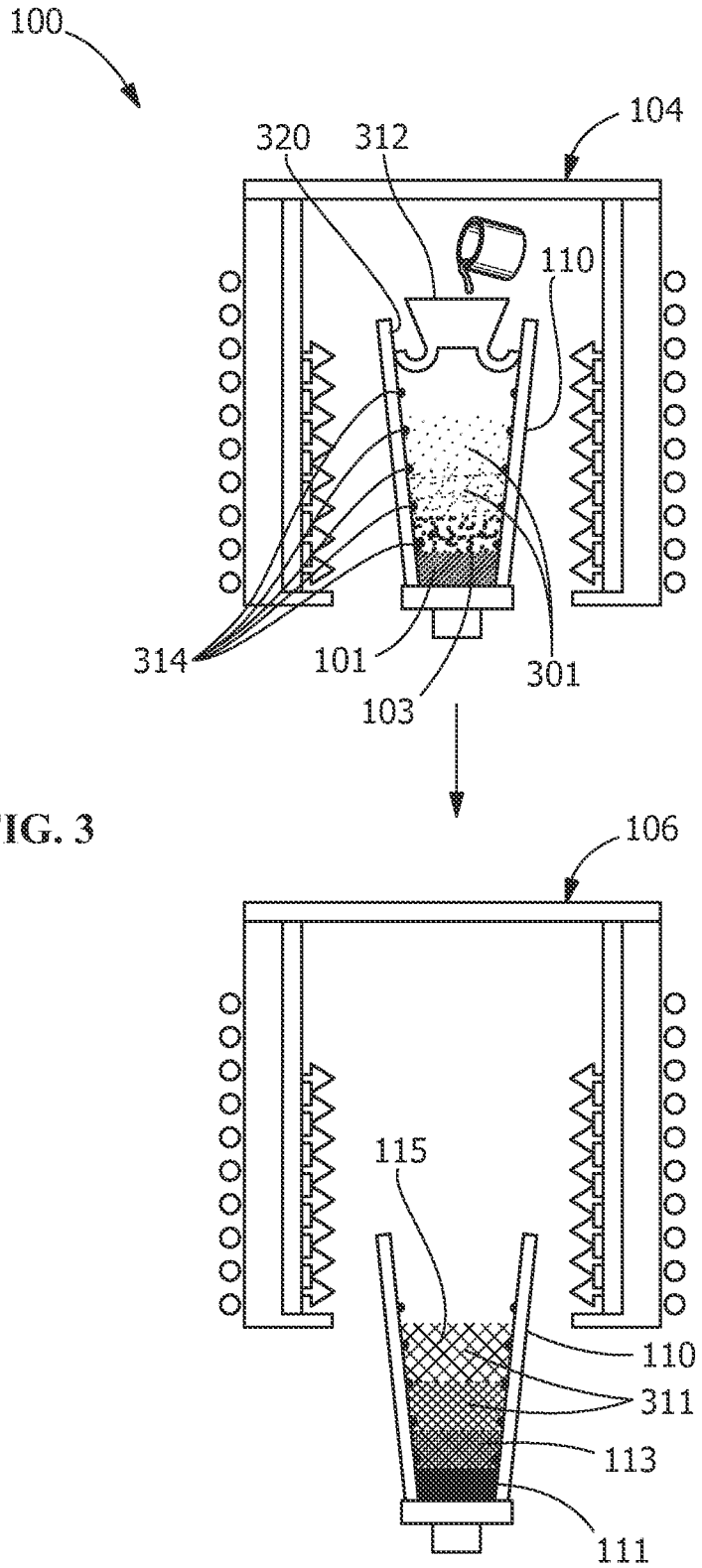
FIG. 3 is a schematic view of an exemplary casting method producing an exemplary cast article having equiaxed grain according to an embodiment of the disclosure.
Figure 4:
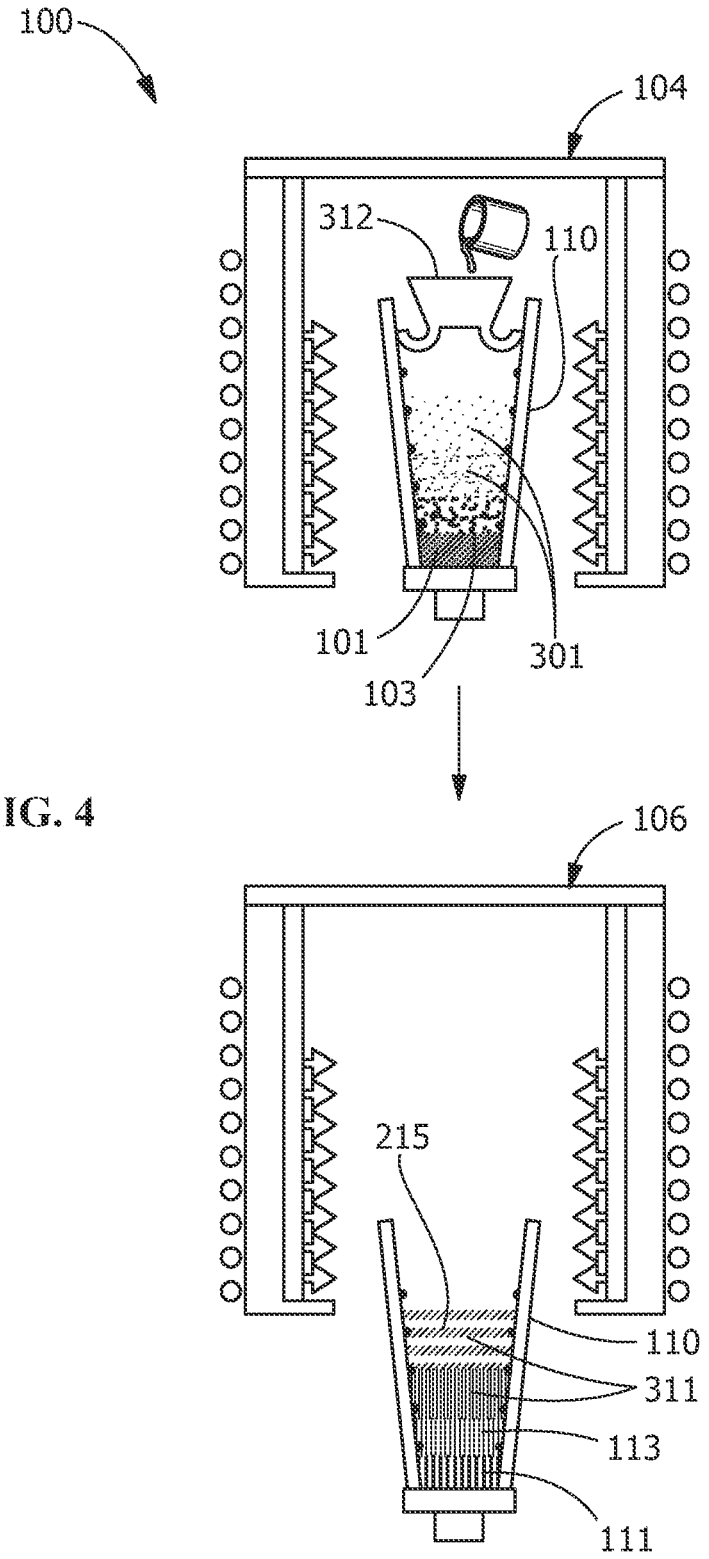
FIG. 4 is a schematic view of an exemplary casting method producing an exemplary cast article having directional solidification grain according to an embodiment of the disclosure.

Referring to FIG. 3 and FIG. 4, in one embodiment, the mold 110 has a top-fed configuration 312. The top-fed configuration 312 directs the fluid material 103 to the upper portion 118 of the mold 110 through a funnel shaped member. The funnel shaped member rests within the upper portion 118 of the mold 110, and has a curved lip for directing material to the inner face 320 of the mold 110. The fluid material 103 has a density lower than the base material 101 and remains above the base material 101 in the mold 110. The base material 101 and the fluid material 103 are cooled within the mold 110 (step 106), forming a cast article 109.

In one embodiment, a flow control feature is coupled to the mold 110 for reducing or preventing an increase in a rate of the directing of the fluid material 103 (step 104). The flow control feature prevents turbulent flow from disrupting the density driven separation of the base material 101 and the fluid material 103. Referring to FIG. 1 and FIG. 2, in one embodiment, the flow control feature includes a flow restrictor 114, for example, in the bottom-fed configuration 112. In a further embodiment, the bottom-fed configuration 112 includes a plurality of sealable passages (not shown). The plurality of passages is sealed when not in use to prevent back flow of the fluid material 103. Referring to FIG. 3 and FIG. 4, in one embodiment, the flow control feature includes protrusions 314, for example, along an inner face 320 of the mold 110. The protrusions 314 are a plurality of semi-circular members extending inwardly from the inner face 320 of the mold 110. The protrusions 314 are oriented horizontally on the inner face 320 and extend along the length of the inner face 320, each protrusion 314 contributing to a tortuous path for preventing an increase in a flow rate of the fluid material 103. As the fluid material 103 flows along the inner face 320, the protrusions 314 slow the rate of flow.

Referring to FIG. 3 and FIG. 4, in one embodiment, one or more additional fluid materials 301 is/are directed into the mold 110. The additional fluid material(s) 301 form(s) additional portion 311 of the cast article 109. As will be appreciated, the additional fluid materials 301 are the same materials, same type of materials, different materials, or different type of materials in comparison to the fluid material 103 and/or each other.

In one embodiment, the composition of the base material 101 and/or the fluid material 103 is/are, by weight, of less than 0.12% carbon, less than about 0.01% silicon, less than about 0.001% manganese, less than about 5.72% aluminum, less than about 0.02% boron, less than about 0.1% columbium, less than about 9.4% cobalt, less than about 5.6% chromium, less than about 0.002% copper, less than about 0.02% iron, less than about 1.5% hafnium, less than about 0.52% molybdenum, less than about 3.0% rhenium, less than about 6.2% tantalum, less than about 0.2% titanium, less than about 8.5% tungsten, less than about 0.013% zirconium, incidental impurities, and a balance of nickel.

In one embodiment, the composition of the base material 101 and/or the fluid material 103 is/are, by weight, of between about 0.07% and about 0.10% carbon, between about 8.0% and about 8.7% chromium, between about 9.0% and about 10.0% cobalt, between about 0.4% and about 0.6% molybdenum, between about 9.3% and about 9.7% tungsten, between about 2.8% and about 3.3% tantalum, between about 0.6% and about 0.9% titanium, between about 5.25% and about 5.75% aluminum, between about 0.01% and about 0.02% boron, between about 1.3% and about 1.7% hafnium, up to about 0.1% manganese, up to about 0.12% silicon, up to about 0.01% phosphorus, up to about 0.004% sulfur, between about 0.005% and about 0.02% zirconium, up to about 0.1% niobium, up to about 0.1% vanadium, up to about 0.1% copper, up to about 0.2% iron, up to about 0.003% magnesium, up to about 0.002% oxygen, up to about 0.002% nitrogen, and a balance nickel and incidental impurities.

In one embodiment, the composition of the base material 101 and/or the fluid material 103 is/are, by weight, of between about 0.09% and about 0.13% carbon, between about 15.70% and about 16.30% chromium, between about 8.00% and about 9.00% cobalt, between about 1.50% and about 2.00% molybdenum, between about 2.40% and about 2.80% tungsten, between about 1.50% and about 2.00% tantalum, between about 0.60% and about 1.10% columbium, between about 3.20% and about 3.70% titanium, between about 3.20% and about 3.70% aluminum, between about 0.005% and about 0.020% boron, between about 0.015% and about 0.050% zirconium, up to about 0.35% iron, up to about 0.10% manganese, up to about 0.30% silicon, up to about 0.007% sulfur, and a balance nickel.

In one embodiment, the composition of the base material 101 and/or the fluid material 103 is/are, by weight, of less than about 15% chromium, less than about 9.6% cobalt, less than about 3.9% tungsten, less than about 1.6% molybdenum, less than about 5.0% titanium, less than about 3.1% aluminum, less than about 0.2% carbon, less than about 0.02% boron, less than about 2.9% tantalum, and a balance of nickel.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A casting method, comprising:

(i) flowing, in sequence, into a single opening of a mold, each of a base material having a first density and a first composition and a fluid material having a second density and a second composition, the step of flowing selected from:

flowing the base material followed by flowing the fluid material into a bottom fed mold opening when the fluid material has a density that is larger than that of the base material; and, flowing the base material followed by flowing the fluid material into a top fed mold opening when the fluid material has a density that is smaller than that of the base material whereby the difference in density causes the base material to separate from the fluid material within the mold; and, (ii) subjecting the mold to withdrawal cooling by lowering the mold in a linear, vertical direction, thereby solidifying the base material and the fluid material to form a cast article, wherein the base material forms a first portion of the cast article and the fluid material forms a second portion of the cast article.

2. The casting method of claim 1, wherein the cast article includes a first region having a first coefficient of thermal expansion, and a second region having a second coefficient of thermal expansion, the first coefficient of thermal expansion differing from the second coefficient of thermal expansion.

3. The casting method of claim 1, wherein the cast article contains a greater concentration of equiaxed grains compared to directional solidification grains.

4. The casting method of claim 1, wherein the cast article comprises a greater concentration of directional solidification grains than equiaxed grains.

5. The casting method of claim 1, wherein the mold is a bottom-fed mold.

6. The casting method of claim 1, wherein the mold is a top-fed mold including a funnel shaped member having a curved lip arranged and disposed to flow material to an inner face of the mold.

7. The casting method of claim 1, wherein the mold is cooled at a rate that produces a greater concentration of equiaxed grains compared to directional solidification grains.

8. The casting method of claim 1, wherein the mold is cooled at a rate that produces a greater concentration of directional solidification grains compared to equiaxed grains.

9. The casting method of claim 1, comprising a flow control feature coupled to the mold.

10. The casting method of claim 9, wherein the flow control feature includes a flow restrictor for reducing or preventing an increase in a rate of the flowing of the fluid material.

11. The casting method of claim 9, wherein the flow control feature includes protrusions for reducing or preventing an increase in a rate of the flowing of the fluid material.

12. The casting method of claim 1, comprising flowing an additional material into the mold.

13. The casting method of claim 12, wherein the additional material has a density and composition that differs from the density and composition of the base material, and the density and composition of the fluid material.

14. The casting method of claim 12, wherein the additional material has one or more of (i) a density that differs from the density of the base material, (ii) a density that differs from the density of the fluid material, (iii) a composition that differs from the composition of the base material and (iv) a composition that differs from the composition of the fluid material.

15. The casting method of claim 1, wherein the base material is a superalloy.

16. The casting method of claim 1, wherein the fluid material is a superalloy.

17. The casting method of claim 1, wherein the base material and the fluid material do not intermix when flowed into the mold.

18. A casting method, comprising:

(i) flowing, in sequence, into a single opening of a mold, the single opening selected from a top-fed mold opening and a bottom-fed mold opening, a base material followed by a fluid material, one material having a density that is greater than the density of the other, where the material with the greater density is directed toward the bottom of the mold relative to the material with the smaller density, and whereby the difference in density causes the base material to separate from the fluid material within the mold;

(ii) flowing at least one additional material into the mold (iii) optionally repeating step (ii) for one or more additional materials; and, (iv) subjecting the mold to withdrawal cooling to solidify each of the materials to provide a cast article having two or more portions of different materials.

19. The casting method of claim 18, wherein any two or more of the base material, the fluid material, and the at least one additional material do not intermix when flowed in the mold.

20. The casting method of claim 18, wherein the at least one additional material has one or more of (i) a density that differs from the density of the base material, (ii) a density that differs from the density of the fluid material, (iii) a composition that differs from the composition of the base material and (iv) a composition that differs from the composition of the fluid material.

* * * * *